US009662655B2

(12) United States Patent
Iafrate

(10) Patent No.: US 9,662,655 B2
(45) Date of Patent: May 30, 2017

(54) SYSTEM AND METHOD TO MINIMIZE FINE MATERIAL PRODUCED DURING CRUSHING OF FRANGIBLE MATERIAL

(71) Applicant: John A. Iafrate, Clermont, FL (US)

(72) Inventor: John A. Iafrate, Clermont, FL (US)

( * ) Notice: Subject to any disclaimer, the term of this patent is extended or adjusted under 35 U.S.C. 154(b) by 0 days.

(21) Appl. No.: 15/177,972

(22) Filed: Jun. 9, 2016

(65) Prior Publication Data

US 2016/0361720 A1 Dec. 15, 2016

Related U.S. Application Data

(60) Provisional application No. 62/173,042, filed on Jun. 9, 2015.

(51) Int. Cl.

| | |
|---|---|
| ***B02C 1/00*** | (2006.01) |
| ***B02C 1/10*** | (2006.01) |
| ***B02C 1/02*** | (2006.01) |
| ***B02C 1/04*** | (2006.01) |

(52) U.S. Cl.

CPC ..... *B02C 1/10* (2013.01); *B02C 1/025* (2013.01); *B02C 1/04* (2013.01)

(58) Field of Classification Search

CPC .. B02C 1/02; B02C 1/025; B02C 1/10; B02C 1/04

USPC ..... 241/262–270

See application file for complete search history.

(56) References Cited

U.S. PATENT DOCUMENTS

| | | | | |
|---|---|---|---|---|
| 1,254,192 A | | 1/1918 | Bartley | |
| 2,084,622 A | | 6/1937 | Norton | |
| 2,341,105 A | | 3/1939 | Kueneman et al. | |
| 2,264,915 A | | 4/1939 | Meister | |
| 2,204,024 A | * | 6/1940 | Meinhardt | B02C 1/06 241/140 |
| 2,464,732 A | | 3/1949 | Traylor, Jr. | |
| 2,485,718 A | | 10/1949 | Ebersol | |
| 2,506,970 A | * | 5/1950 | Milton | A47J 19/022 100/229 R |
| 2,554,697 A | | 5/1951 | Conway | |
| 2,661,158 A | | 12/1953 | Fogle | |
| 2,707,081 A | | 4/1955 | Schmidtmann | |
| 2,843,329 A | | 1/1958 | Matthews | |
| 3,613,799 A | | 10/1971 | Bodine | |
| 4,848,679 A | | 7/1989 | Blumer | |
| 4,899,942 A | * | 2/1990 | Bohringer | B02C 1/02 241/200 |
| 5,082,187 A | * | 1/1992 | Kirchhoff | B02C 1/00 241/262 |
| 5,110,058 A | | 5/1992 | Rawson | |
| 5,439,179 A | * | 8/1995 | Nolin | B02C 1/005 241/265 |
| 5,569,555 A | * | 10/1996 | Goldstein | B02C 1/005 241/201 |
| 5,806,772 A | | 9/1998 | Karra | |

(Continued)

*Primary Examiner* — Faye Francis

(74) *Attorney, Agent, or Firm* — Terry M. Sanks, Esq.; Beusse Wolter Sanks & Maire, PLLC

(57) ABSTRACT

A system including a nearly horizontal jaw movable to reduce a size of frangible material, a stationary cover around a top side of the jaw, an area is defined between an outer surface of the jaw and an inner surface of the cover, and a drive mechanism to cause the jaw to move to vary the area between the cover and the jaw to reduce the size of frangible material within the area. Another system and method are also disclosed.

20 Claims, 5 Drawing Sheets

(56) References Cited

U.S. PATENT DOCUMENTS

| | | | | |
|---|---|---|---|---|
| 6,499,681 | B1 | 12/2002 | Maruyama | |
| 7,108,210 | B1 | 9/2006 | Hugen | |
| 7,942,354 | B2 | 5/2011 | Didion | |
| 9,421,547 | B2 * | 8/2016 | Boast | B02C 1/025 |
| 2001/0034003 | A1 | 10/2001 | Wellmann | |
| 2013/0092769 | A1 | 4/2013 | Schenk | |
| 2013/0320123 | A1 * | 12/2013 | Boast | B02C 1/025<br>241/262 |

* cited by examiner

SYSTEM AND METHOD TO MINIMIZE FINE MATERIAL PRODUCED DURING CRUSHING OF FRANGIBLE MATERIAL

CROSS-REFERENCE TO RELATED APPLICATION

This application claims the benefit of U.S. Provisional Application No. 62/173,042, filed Jun. 9, 2015, and incorporated herein by reference in its entirety.

FIELD OF THE INVENTION

Embodiments relate to crushers and in particular to a type of crusher generally used to break concrete and rock into smaller size aggregate, including crushers used to comminute masses of reinforced concrete and asphalt taken from demolition sites and stone taken from quarries.

BACKGROUND

Crushing devices are known in the art for use to reduce large pieces of frangible material such as, but not limited to, concrete, rock, asphalt, etc., to smaller pieces. For the most part, jaw crushers now in use have proven to be satisfactory for most of their intended purposes including, feed size, hard rock capability, reduction ratio, product characteristics, throughput and economy. However, improvements in each of these areas are still possible. For example, many prior art jaw-type crushers have a fixed jaw and a large heavy movable jaw. In a majority of the prior art jaw-type crushers, eccentrically mounted rotatable jaws are driven by motors where the frangible material passes over at least one of the jaws. Since the frangible material is placed on at least one of the eccentrically mounted rotatable jaws, the motor driving the jaw would have to produce sufficient force to allow the jaw to produce its eccentric movement even with the additional weight from the frangible material. Because of the added weight upon such jaws, this type of prior art jaw-type crusher could typically experience more wear and tear than crushers that did not apply additional weight to an eccentrically mounted rotatable jaw.

Furthermore, such crushers are constructed so that material does not fall away from the jaw(s) until the material is of a defined size. Thus, pieces of the material may remain engaged with the jaw(s) creating fine material until the pieces are of a small enough size to fall away from the jaw(s). While the crushed material may be reused, the fine material does not have as many reusable purposes. Therefore entities wishing to break frangible material into smaller pieces would benefit from a system and method which provides for breaking of frangible material where a production of fine material is minimize.

BRIEF SUMMARY

Embodiments relate to a system and a method for crushing frangible material. The system comprises a jaw movable during operation of the system, the jaw comprising an upper part to make contact with frangible material and a lower part. A cover that is stationary during operation of the system is provided. The cover surrounds at least a segment of an upper part of the jaw to create an area between the jaw and the cover to reduce a size of frangible material during operation of the system. A tray located at the lower part of the jaw to capture frangible material that falls from the area between the jaw and the cover is also provided.

Another system comprises a nearly horizontal jaw movable to reduce a size of frangible material. The system also comprises a stationary cover around a top side of the jaw, an area is defined between an outer surface of the jaw and an inner surface of the cover. The system also comprises a drive mechanism to cause the jaw to move in a plurality of directions to vary the area between the cover and the jaw to at least one of reduced size of frangible material within the area and self-relieve frangible material wedged, stuck, etc., between the jaw and the cover.

The method comprises moving a nearly horizontal jaw driven in a plurality of directions by a drive mechanism with an upper part of the jaw surrounded by a stationary cover that with the jaw defines an area between the jaw and the cover to reduce a size of frangible material. The method also comprises capturing frangible material that is reduced in size to fall from within the area between the jaw and the cover with a tray located at the lower part of the jaw and that is in motion by operation of the drive mechanism. The method also comprises removing frangible material that is reduced in size from at least one of the area between the jaw and the cover and tray with a conveyor system.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION

Figure 1:
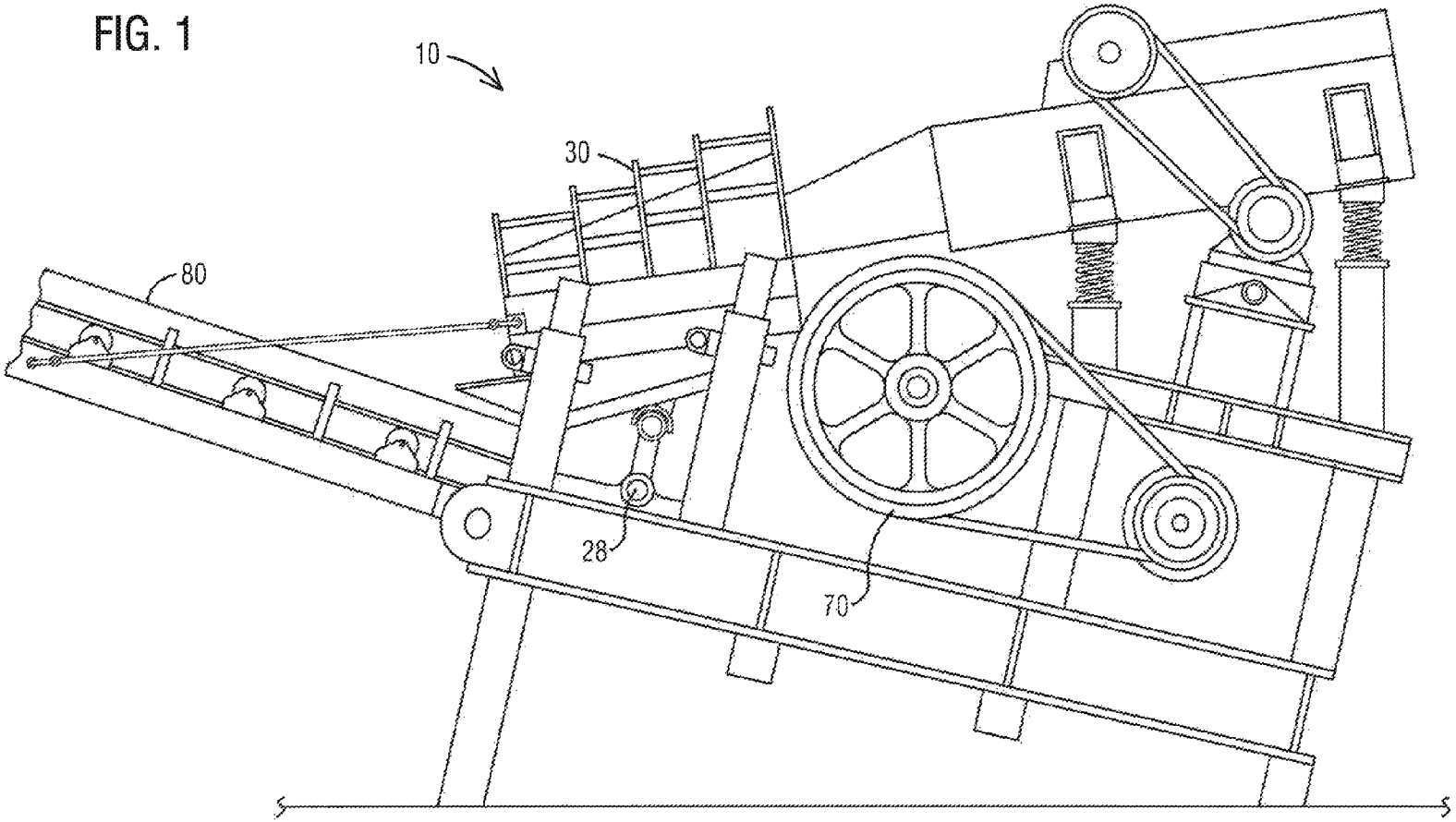
FIG. 1 shows an embodiment of a system which minimizes a production of fine material when crushing frangible material.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

FIG. 1 shows an embodiment of a system which minimizes a production of fine material when crushing frangible material. Whereas many prior art crushers are arranged vertically so that frangible material is primarily acted upon by gravity to direct it to be crushed, the system 10 may not be vertical. As such, the system 10 actually has less height when compared to prior art crushers. A height of the system 10 is determinable based on an angle of a jaw 20 or a cover 30 with respect to the ground. The system 10 is placed at an angle such as, but not limited to, approximately six degrees (plus or minus 2 degrees) to approximately eighty degrees (plus or minus 10 degrees). Hence, at the minimum height, approximately six degrees, the system 10 is nearly horizontal.

As further shown in FIG. 1, a drive mechanism 70 is provided. The drive mechanism 70 may be provided to cause movement of the jaw 20 in a lifting and lowering movement in at least one of a forward direction and a backward direction. In another non-limiting example, the movement of the jaw 20, caused by the drive mechanism 70, is an eccentric movement. A conveyor system 80 is also shown. The conveyor system 80 is positioned to catch the crushed material and to transport it away from the jaw 20 and cover 30.

Being nearly horizontal, or horizontal, a lower feed height is realized when compared to prior art crushers. Also, the embodiments disclosed herein can accept longer pieces of frangible material when compared to prior art crushers. Furthermore, by being nearly horizontal, a smoother or more direct transition from the jaw 20 and cover 30 to the conveyor system 80 is realized as the conveyor is also positioned nearly horizontal or horizontal with respect to the surface upon which the system rests or sits.

Figure 2:
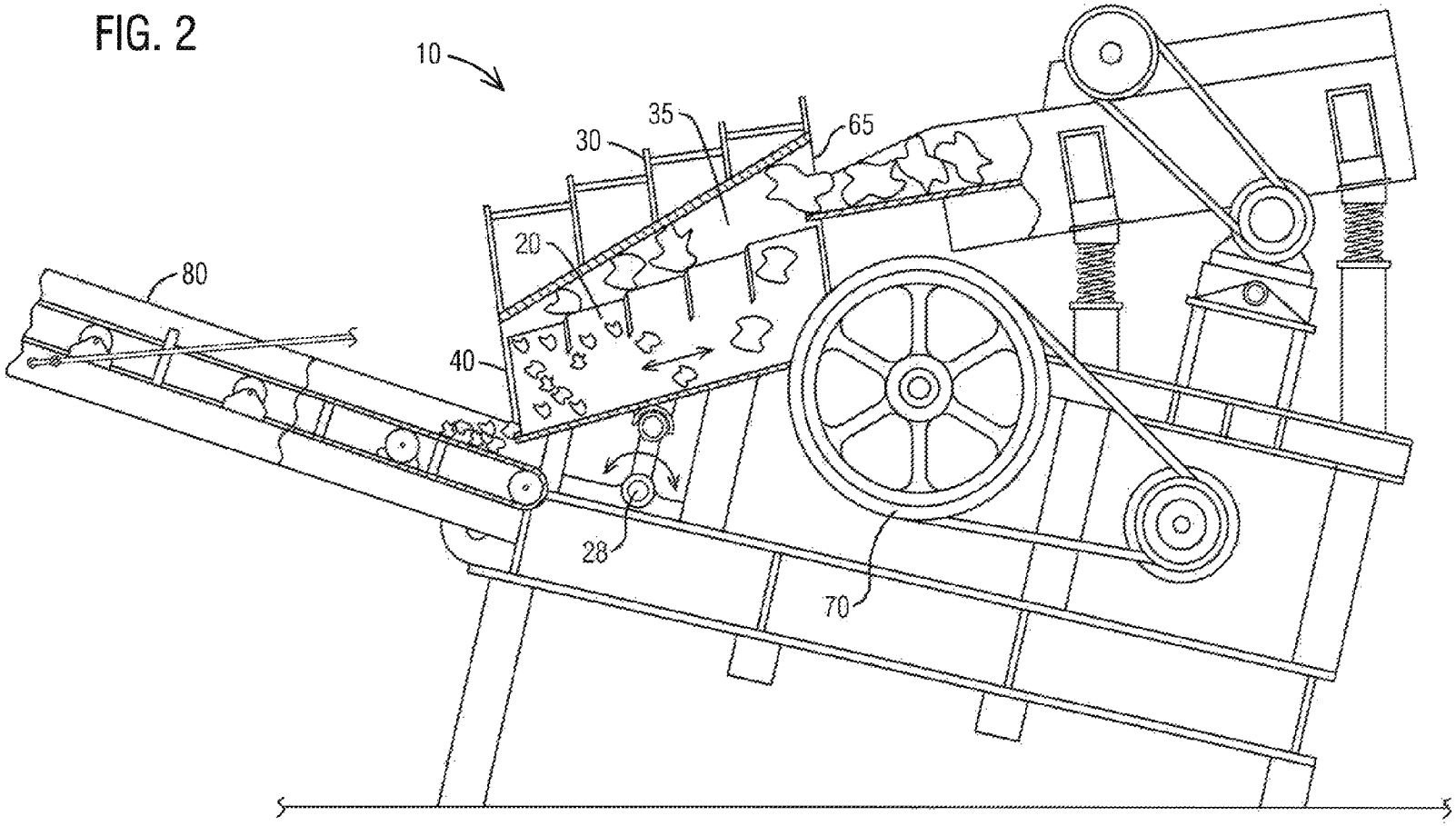
FIG. 2 shows an embodiment of the system with the cover cut away to show the jaw.

FIG. 2 shows an embodiment of the system with the cover cut away to show the jaw. As illustrated, the system 10 comprises a tapered jaw 20 angled in a downward direction along its length and configured to have a lifting and lowering movement in at least one of a forward direction and a backward direction. The cover 30 surrounds an upper part of the jaw 20 and defines an area 35 between the cover 30 and the jaw 20 along the length, or elongated part, of the jaw. The cover 30 further assists in defining an opening 40 between at least a side between the cover 30 and the jaw 20. A connector 28 may provide for further movement of the jaw 20 initiated by the drive mechanism 70.

The movement of the jaw 20 causes frangible material to pass along the length of the jaw 20 and to be removed from the jaw 20 through the opening 40 when the frangible material has achieved a size to pass through the opening 40. Thus, as configured, frangible material small enough to pass through the opening 40 may do so. Furthermore, since the broken frangible material may exit the jaw 20 and cover 30 sooner it helps to minimize an amount of fine material which prior art systems produce. In other words, the movement of the jaw 20 with respect to the cover 30 only maintains frangible material within these two components until they are of a size to pass beyond these components. By doing so, frangible material is not left within these components being grinded further, which would result in further reduction in size causing the creation of fine material. As the frangible material is moved along the length of the jaw 20, the pieces of frangible material, that are small enough to pass through the opening 40, pass through. Other remaining pieces will stay within the system 10, specifically between the cover 30 and jaw 20, until they are of a size capable of exiting through the opening 40. A tray, or base, 50 is provided and is attached to the jaw 20. The tray may catch the frangible material that is already no longer requiring further reduction in size by engaging the jaw 20 and cover 30, and is moved towards the opening 40 by movement of the jaw 20.

Figure 3:
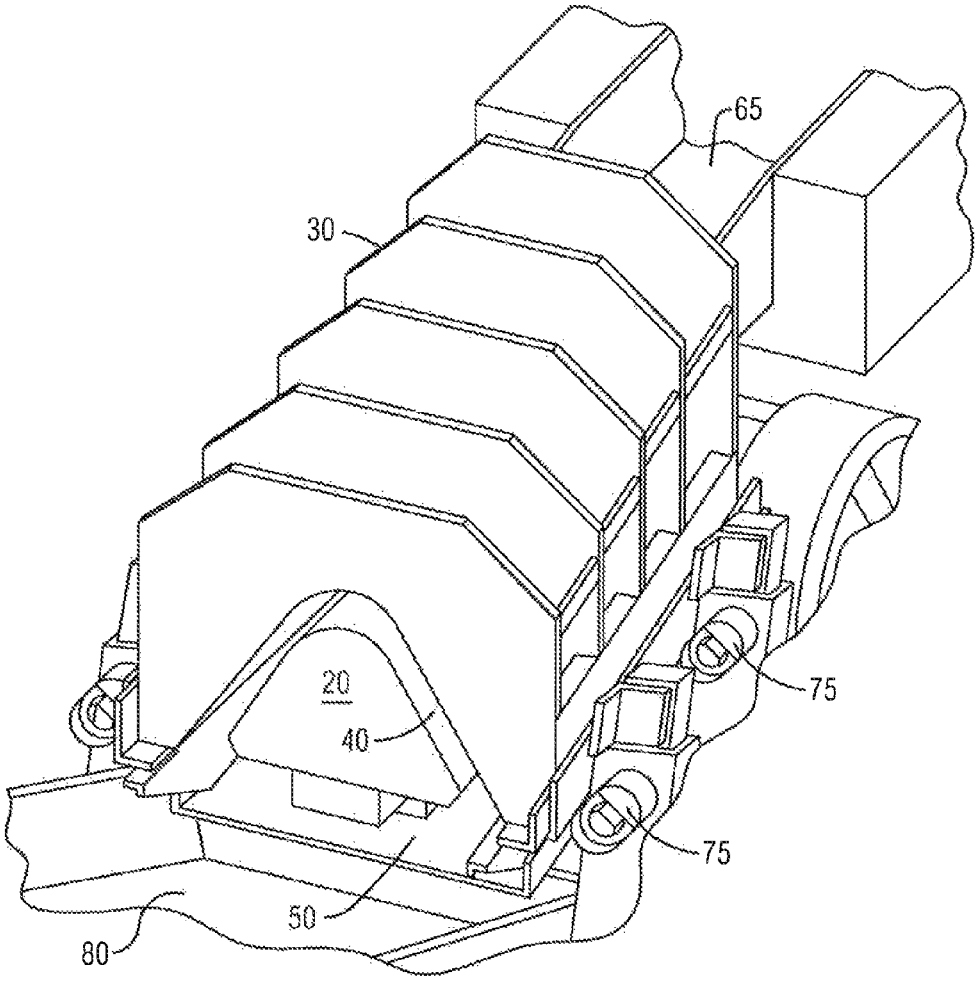
FIG. 3 shows an embodiment of the cover around the jaw.

FIG. 3 shows an embodiment of the cover around the jaw. More specifically, as illustrated in FIG. 3, the plate or cover 30 surrounds the elongated jaw 20 where both are angled downward. Broken frangible material is expended from the sides of the jaw 20 at the opening 40 created between the jaw 20 and the cover 30. The frangible material may pass through the opening 40 directly from being in contact with both the jaw 20 and cover 30 or once resting on the tray 50. The term "sides" as used above means along any surface of the jaw 20. Also as also illustrated, the frangible material is fed into the system 10 at a distal end 60 of the jaw 20 when compared to the location of the opening 40.

As further illustrated in FIG. 2, the cover 30 may have a tapered shape, meaning more space is provided for between the cover 30 and jaw 20 at the distal end 60 of the jaw 20 when compared to the opening 40. The tapered shape of the cover 30 may be at a similar tapered angle as the jaw 20. In another embodiment, the tapered angle of the cover 30 may be different than the jaw 20. In another embodiment, the cover is arranged to provide for increased crushing of material at an earlier location, closer to the distal end 60, on the jaw 20. Thus, a reverse tapering of the cover 30 with respect to the jaw 20 may be employed. Thus, in that embodiment, the crushing may be considered uniform since the cover 30 is forcing crushing to occur earlier than if the cover 30 and jaw 20 had a similar tapered angle. In essence, the cover may be placed or arranged to create an angle between the inner surface of the cover and the jaw 20.

The cover 30 may also be adjustable, meaning that it may be located so as to adjust the area 35 between the jaw 20 and the cover 30. The adjustment may also adjust a size of the opening 40. As explained herein, the opening 40 on a first side of the jaw 20 may be the same or different than the opening 40 on the second side of the jaw 20. This may be possible as the cover may be positioned closer to one side of the jaw 20 than the second side of the jaw 20.

Once placed at a desired position, the cover 30 may then be secured so that it does not move during operation of the system 10. Thus, as explained above, the cover 30 may be angled at an angle different than the angle of the jaw 20. As a non-limiting example, the cover 30 may have a greater angle to allow a greater area near the base 50 of the jaw 20.

Figure 4:
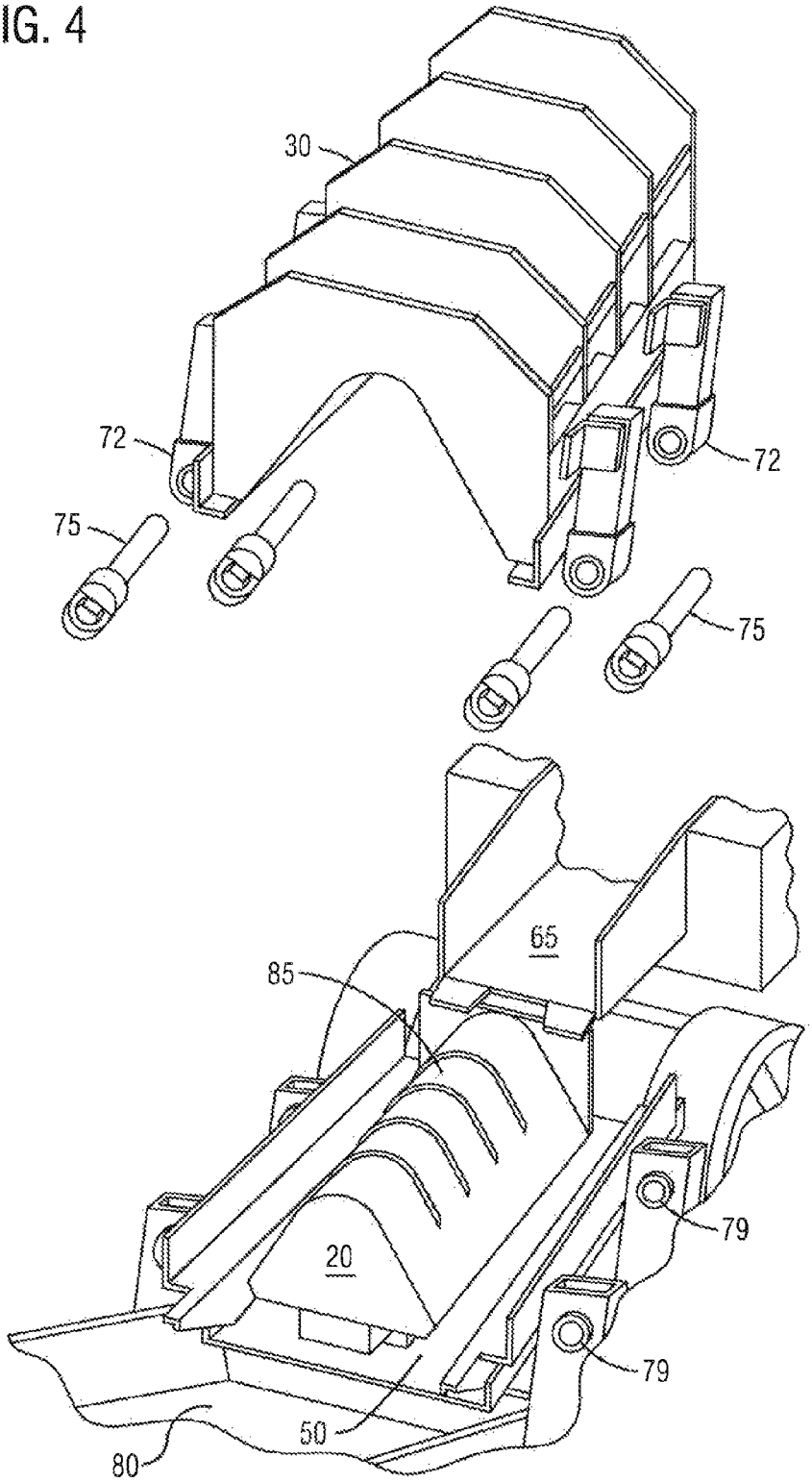
FIG. 4 shows an embodiment of the elongated jaw and the cover separated.

FIG. 4 shows an embodiment of the elongated jaw and the cover separated. The jaw 20 may comprise a tapered shape or semi-triangular shape, when viewing the jaw 20 from either the opening 40 or distal end 60. Further shown is the base 50 located beneath the jaw 20. A shape of the jaw 20 may comprise other shapes. As a non-limiting example, the width of the jaw 20 may either increase or decrease along its length from the distal end 60 to the opening 40. Though the outer surface of the jaw 20 is shown as being segmented, in another embodiment it may be a smooth transition. More specifically, an outer surface of the jaw 20 may comprise a plurality of segments 85 of different diameters along the length of the jaw 20. The segments 85 may be symmetric or non-symmetric, as illustrated, with respect to the other segments 85. In another embodiment, a pattern may be inscribed, or etched in a surface of the jaw 20 to further assist with breaking of the frangible material. An entrance, or passage, 65 is provided at the distal end 60 of the jaw 20 for frangible material to enter between the cover 30 and jaw 20. At the opening 40, that end of the jaw 20 may have an apex shape, a blunt shape, or a flattened end shape.

The cover 30 may be stationary during operation of the system 10. At least one connector 75 is provided to secure the cover to a part of the system 10 so that the cover is stationary during operation. Thus, receivers 72, 79 are provided on the cover 30 and the system and the connector 75 secures respective receivers together. In another embodiment, hydraulic cylinders may be used to hold the cover 30 in place.

As mentioned above, in operation, the jaw 20 not only crushes the frangible material, but based on its movement, also pushes or moves the material forward along the elongated length of the jaw 20. Thus, the jaw acts as a feeder. Doing so provides for less wear and tear on the drive mechanism 70 since frangible material is not concentrated at a signal region of the jaw during the breaking process. Less wear and tear is also realized as the jaw 20 and tray 50 are moving during operation which causes self-relieving of frangible material from being wedged, stuck, or packed between the jaw 20 and the cover 30. Furthermore, less horsepower from the drive mechanism 70 is required. This is also due to the frangible material remaining loose, or not bunching up at a specific location along the jaw 20. By the time frangible material approaches the end of the jaw 20 proximate the opening 40, much of the frangible material has already been broken down to a size that it has already passed from within the area 35 between the jaw 20 and the cover 30 and has fallen onto the conveyor 80 and transported away from the system 10. This further results in fewer or less fines or fine material being produced, when compared to prior art system, since the fines are not as usable as the crushed frangible material. Furthermore, because of the shape of the jaw 20, the system 10 is self-relieving as the movement of the jaw 20 in combination with the openings 40 provides for frangible material to exit the system immediately once of a size to pass through the opening 40. The properly sized material can pass through the opening 40 either where the length of the elongated jaw 20 terminates at the opening 40. This is further realized as the tray captures early crushed frangible material and moves it towards the opening 40 by movement of the jaw 20 which also results in the moving of the base 50.

Thus, as disclosed above, the system 10 may comprise a jaw 20 that is movable during operation of the system 10. The jaw 20 may comprise an upper part to make contact with frangible material and a lower part. The cover 30 may be stationary during operation of the system 10. The cover 30 surrounds at least a segment of an upper part of the jaw 20 to create an area 35 between the jaw 20 and the cover 30 to reduce a size of frangible material during operation of the system 10. The tray 50 may be located at the lower part of the jaw 20 to capture frangible material that falls from the area between the jaw 20 and the cover 30. The jaw and the cover define an entrance 65 into which frangible material reduced in size is fed. The jaw 20 and the cover 30 may define an exit 40 from which frangible material that has been reduced in size is removed from at least one of between the jaw 20 and the cover and the tray by movement of the jaw 20 during operation of the system 10.

An outer surface of the upper part of the jaw 20 may comprise a smooth surface or a plurality of segments where at least two of the segments of the plurality of segments are of different height, dimension, size, etc. A receiving device 80 to collect frangible material that passes from the jaw and cover is disclosed. The receiving device may be a conveyor system. The jaw 20 is approximately six degrees to approximately eighty degrees from a surface upon which the system is placed. The cover 30 may also be placed at approximately the same degrees as the jaw 20. The cover 30 may be adjustable to define the area 35 between the cover and the jaw prior to operation of the system. Furthermore, the area 35 between the cover 30 and the jaw 20 may decrease from where frangible material is placed between the cover and the jaw and where the reduced sized frangible material exits from between the cover and the jaw 20. The jaw 20 may comprise a generally triangular shape with a rounded vertex or the jaw 20 may comprise a tapered shape along its length with a base of the jaw 20 being larger at a first end and smaller at a second end.

In another embodiment, the system 10 comprises a nearly horizontal jaw 20 that is movable to reduce a size of frangible material, a stationary cover 30 around a top side of the jaw 20, an area 35 is defined between an outer surface of the jaw 20 and an inner surface of the cover 30, and a drive mechanism 70 to cause the jaw 20 to move to vary the area between the cover 30 and the jaw 20 to reduce the size of frangible material within the area 35.

A tray 50 may be provided to capture frangible material that has been reduced in size, but is still within the area between the jaw 20 and the cover 30. The tray 50 may be movable by the drive mechanism 70 to cause the material within the tray 50 to move from the area between the jaw 20 and the cover 30 to an exit location 40. The conveyor 80 captures frangible material that has been reduced in size to escape from within the area between the jaw 20 and the cover 30 during operation of the drive mechanism 70. As discussed above, the cover 30 may be adjustable to define the area 35 between the cover 20 and the jaw 30. The area 35 between the cover 30 and the jaw 20 may decrease from where frangible material is placed between the cover 30 and the jaw 20, the entrance 65 and where the reduced sized frangible material exits 40 from between the cover 30 and the jaw 20. The nearly horizontal jaw 20 is approximately six degrees to approximately eighty degrees from a surface upon which the system 10 is placed.

Figure 5:
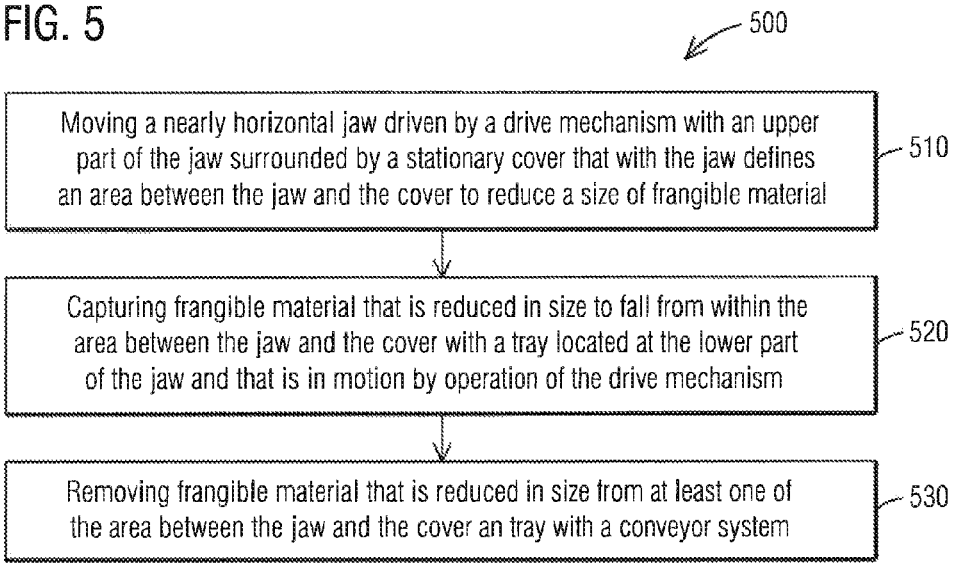
FIG. 5 shows a flowchart illustrating an exemplary embodiment of a method for minimizing a production of fine material.

FIG. 5 shows flowchart illustrating an embodiment of a method for minimizing production of fine material. The method 500 comprises moving a nearly horizontal jaw driven by a drive mechanism with an upper part of the jaw surrounded by a stationary cover that with the jaw defines an area between the jaw and cover to reduce a size of frangible material, at 510. The method further comprises capturing frangible material that is reduced in size to fall from within the area between the jaw and cover with a tray located at the lower part of the jaw and that is in motion by operation of the drive mechanism, at 520. The method also comprises removing frangible material that is reduced in size from at least one of the area between the jaw and cover and tray with a conveyor system, at 530.

Figure 6:
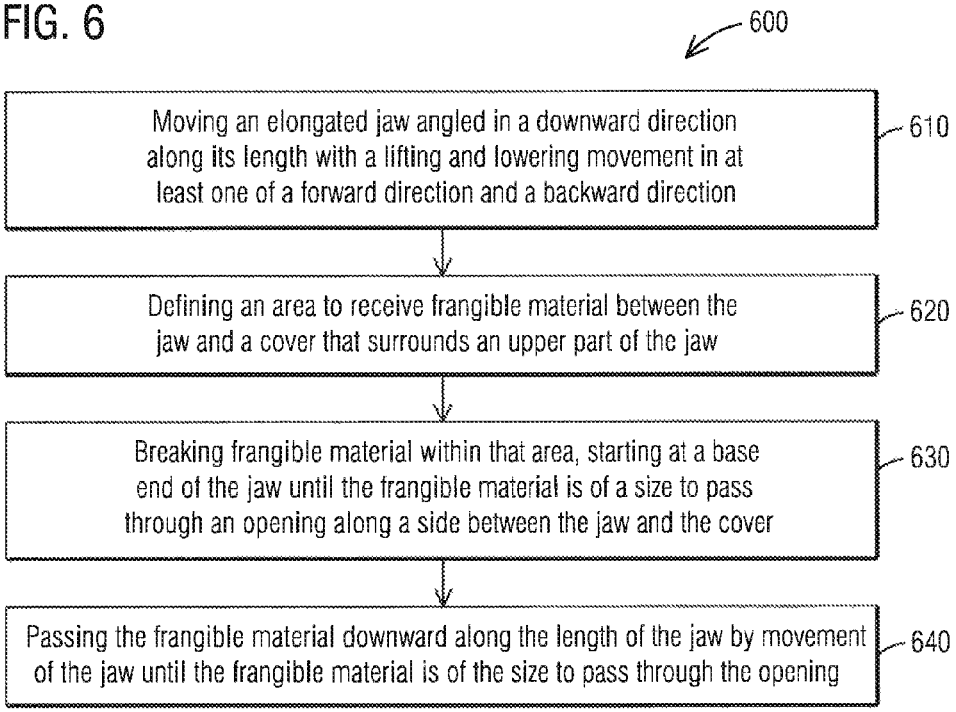
FIG. 6 shows another flowchart illustrating an embodiment of a method for minimizing production of fine material.

FIG. 6 shows another flowchart illustrating an embodiment of a method for minimizing a production of fine material. The method 700 comprises moving a tapered jaw angled in a at least one of an eccentric motion, a forward direction and a backward direction along its length with a lifting and lowering movement in at least one of a forward direction and a backward direction, at 710. The method 700 also comprises defining an area to receive frangible material between the jaw and a cover that surrounds an upper part of the jaw, at 720. The method further comprises breaking frangible material within the area, starting at a base end of the tapered jaw until the frangible material is of a size to pass ("to pass" includes being capable of passing") through an opening along a side between the jaw and the cover, at 730. The method also comprises passing the frangible material downward along the length of the jaw by movement of the jaw until the frangible material is of the size to pass through the opening, at 740. Those skilled in the art will recognize that utilizing this method, the frangible material is being transformed from larger pieces of material such as, but not limited to, concrete slabs, into smaller pieces of material that may then be recycled for use in other products. By continuously passing pieces of frangible material further along the length of the jaw until small enough to pass through the opening reduces an amount of fine material produced during the crushing.

Thus, in addition to producing less fine material, the embodiments disclosed above also provide for non-packing of the frangible material during the crushing process. This is due to the system 10 being nearly horizontal so that the movement of the jaw 20 is not negatively impacted by gravitational forces as the frangible material is moved primarily in a forward and backward direction during the crushing process and not primarily in a vertical direction during the crushing process. When compared to prior art crushers, gravity usually prohibits frangible material to move backwards or toward where the frangible material initially engages a jaw. Thus, the embodiments disclosed herein provides for a self-relieving system and method. The driving mechanism 70 is causing sufficient movement of the jaw 20 and tray 50 to where any packed material is forcibly dislodged.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

Therefore, the breadth and scope of the subject matter provided herein should not be limited by any of the above explicitly described embodiments. Rather, the scope of the embodiments should be defined in accordance with the following claims and their equivalents.

What I claim is:

1. A system comprising:

a jaw movable during operation of the system, the jaw comprising an upper part to make contact with frangible material and a lower part and a front end and a back end;

a cover stationary during operation of the system, the cover located above the movable jaw and surrounds at least a segment of the upper part of the jaw to create an area between the jaw and the cover to reduce a size of frangible material during operation of the system; and a tray located at the lower part of the jaw to capture frangible material that falls from the area between the jaw and the cover.

2. The system according to claim 1, wherein the jaw and the cover define an entrance at the back end into which frangible material to be reduced in size is fed between the jaw and the cover.

3. The system according to claim 1, wherein the jaw and the cover define an exit location from which frangible material that has been reduced in size is removed at least one of from between the jaw and the cover and from the tray, by movement of the jaw during operation of the system.

4. The system according to claim 1, wherein an outer surface of the upper part of the jaw comprises at least one of a smooth surface and a plurality of segments.

5. The system according to claim 4, wherein the at least two of the segments of the plurality of segments are of different height.

6. The system according to claim 1, further comprising a receiving device to collect frangible material that passes from the jaw and the cover.

7. The system according to claim 1, further comprising a drive mechanism to move at least one of the jaw and the jaw and tray in a plurality of directions to self-relieve frangible material that is stuck between the jaw and the cover.

8. The system according to claim 1, wherein the jaw is approximately six degrees to approximately eighty degrees from a surface upon which the system is placed.

9. The system according to claim 1, wherein the cover is adjustable to define the area between the cover and the jaw prior to operation of the system.

10. The system according to claim 1, wherein the area between the cover and the jaw decreases from where frangible material is placed between the cover and the jaw and where a reduced sized frangible material exits from between the cover and the jaw.

11. The system according to claim 1, wherein the jaw comprises a triangular shape with a rounded vertex.

12. The system according to claim 1, wherein the jaw comprises a tapered shape along its length with a base of the jaw being larger at a first end and smaller at a second end.

13. A system comprising:

a horizontal jaw movable to reduce a size of frangible material;

a stationary cover located above the jaw to surround at least a part of a top side of the jaw, an area is defined between an outer surface of the jaw and an inner surface of the cover;

a drive mechanism to cause the jaw to move in a plurality of directions to vary the area between the cover and the jaw to at least one of reduced size of frangible material within the area and self-relieve frangible material wedged between the jaw and the cover.

14. The system according to claim 13, further comprising a tray to capture frangible material that has been reduced in size, but is still within the area between the jaw and the cover.

15. The system according to claim 14, wherein the tray is attached to the jaw and is movable by the drive mechanism to cause the frangible material within the tray to move from the area between the jaw and the cover to an exit location.

16. The system according to claim 13, further comprising a conveyor to capture frangible material that has been reduced in size to escape from within the area between the jaw and the cover during operation of the drive mechanism.

17. The system according to claim 13, wherein the cover is adjustable to define the area between the cover and the jaw.

18. The system according to claim 1, wherein the area between the cover and the jaw decreases from where frangible material is placed between the cover and the jaw and where the reduced sized frangible material exits from between the cover and the jaw.

19. The system according to claim 2, wherein an end where the entrance is located on the jaw is angled approximately six degrees to approximately eighty degrees at least one of above the front end and from a surface upon which the system is placed.

20. A method comprising:

moving a horizontal jaw driven in a plurality of directions by a drive mechanism with an upper part of the jaw surrounded by a stationary cover, located above the jaw, that with the jaw defines an area between the jaw and the cover to reduce a size of frangible material;

capturing frangible material that is reduced in size to fall from within the area between the jaw and the cover to a tray located at a lower part of the jaw and that is in motion by operation of the drive mechanism; and removing frangible material that is reduced in size from at least one of the area between the jaw and the cover and tray with a conveyor system.

* * * * *